US006367442B1

(12) United States Patent
Takayanagi

(10) Patent No.: US 6,367,442 B1
(45) Date of Patent: Apr. 9, 2002

(54) FOUR-CYCLE OUTBOARD MOTOR

(75) Inventor: Masashi Takayanagi, Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/651,688

(22) Filed: Aug. 30, 2000

(30) Foreign Application Priority Data

Aug. 31, 1999 (JP) ..... 11-246809

(51) Int. Cl.[7] ..... F01M 1/00

(52) U.S. Cl. ..... 123/196 W; 123/195 P; 440/900

(58) Field of Search ..... 123/196 R, 195 P, 123/196 W, 90.27, 198 C; 440/900

(56) References Cited

FOREIGN PATENT DOCUMENTS

| | | | |
|---|---|---|---|
| JP | 02274691 | A | 11/1990 |
| JP | 04345592 | A | 12/1992 |
| JP | 05026175 | A | 2/1993 |
| JP | 07324659 | A | 12/1995 |
| JP | 08100614 | A | 4/1996 |
| JP | 10159532 | A | 6/1998 |
| JP | 10218090 | A | 8/1998 |

*Primary Examiner*—Noah P. Kamen
(74) *Attorney, Agent, or Firm*—Morrison Law Firm

(57) ABSTRACT

The present invention seeks to provide a four-cycle outboard motor that has a simple construction and a compact design. According to the present invention, the outboard motor 1 having a crankshaft 4 disposed substantially vertically within the engine 3, wherein the rotation of this crankshaft 4 is transmitted to a valve camshafts 40 via a looped member 57 disposed at the bottom of the engine 3, comprises an oil pump 64 disposed at a position other than the shaft center position of the crankshaft 4 or the camshafts 40 at the bottom of the engine 3, wherein either this oil pump 64 or a tension adjuster 60 of the looped member 57 is disposed to the inside of the looped member 57 in plan view while the other is disposed outside of the looped member 57 in plan view.

24 Claims, 13 Drawing Sheets

FOUR-CYCLE OUTBOARD MOTOR

This application incorporates by reference the disclosures of co-pending patent applications Ser. No. 09/651,452 by Jun Itoh entitled "Engine Holder Structure For Four-Cycle Outboard Motor" and Ser. No. 09/650,829 by Keisuke Daikoku and Masashi Takayanagi entitled "Four-Cycle Outboard Motor", each of which is filed concurrently with the present application and is assigned to the assignee of the present application.

BACKGROUND OF THE INVENTION

1. Field of the Invention

The present invention relates to a four-cycle outboard motor.

2. Description of the Related Art

An engine of an outboard motor is mounted vertically so that the crankshaft is oriented in the vertical direction and comprises a combination of parts such as a crankcase, a cylinder block, and a cylinder head. If the engine is a four-cycle engine, an oil pan is installed at the bottom of the engine and a lubrication apparatus is installed at the bottom of the engine so as to lubricate the internal parts of the engine with lubricating oil that fills this oil pan and is drawn up by an oil pump.

An example of a conventional lubricating apparatus for an outboard motor is given in Japanese Laid-Open Patent Application H8-100614, where an oil pan is provided beneath the cylinder block and cylinder head, an oil pump is provided at the bottom of the cylinder head inside this oil pan and the oil pump is driven by a camshaft mounted inside the cylinder head.

Another example of a conventional lubricating apparatus for an outboard motor is given in Japanese Laid-Open Patent Application H5-26175. The lubricating apparatus includes an oil pump provided at a portion where the crankshaft sticks out from the lower side of the engine and wherein the oil pump is directly driven by the crankshaft.

When the oil pump is driven by a camshaft, a large oil pump is required in order to ensure the oil quantity and pressure needed for the engine because the camshaft rotates at half of the rotational speed of the crankshaft. Thus, both weight and cost are increased and the engine may not become so compact.

If the oil pump is driven directly by the crankshaft, the entire engine must be disposed at a higher position so that the oil pump does not interfere with a mounting apparatus for attaching the outboard motor to the boat. Thus, the outboard motor becomes larger and the center of gravity of the outboard motor becomes higher.

Interference between the oil pump and a timing chain, for example, is of particular concern with a type of outboard motor equipped with a camshaft drive mechanism at the bottom of the engine. In order to avoid the interference the outboard motor may become even larger.

The present invention was conceived in light of the above situation, and it is an object thereof to provide a four-cycle outboard motor that has a simple construction and a compact design.

SUMMARY OF THE INVENTION

The present invention satisfies the above-described needs by providing a four-cycle outboard motor having a crankshaft disposed substantially vertically within an engine, wherein rotation of this crankshaft is transmitted to a valve camshaft via a looped member disposed at the bottom of the engine, an oil pump disposed at the bottom of the engine but not along the axis of the crankshaft or the camshaft, and a tensioner of the looped member wherein either the oil pump or the tensioner is disposed inside the looped member in plan view and wherein the other is disposed outside the looped member in plan view.

The four-cycle outboard motor, according to the present invention, is further characterized in that the oil pump is at least partially disposed at the same height as the looped member such that the oil pump and the looped member are overlapped if viewed from the side.

The four-cycle outboard motor, according to the present invention, further comprises an oil pump drive apparatus provided to the camshaft wherein the oil pump is driven by the oil pump drive apparatus.

The four-cycle outboard motor, according to the present invention, is further characterized in that the oil pump drive apparatus is set to drive the oil pump at a higher rotational speed than the camshaft.

The present invention satisfies the above-described needs by providing a four-cycle outboard motor having a crankshaft disposed substantially vertically within a engine, wherein rotation of this crankshaft is transmitted to a valve camshaft via a looped member disposed at the bottom of the engine, and an oil pump disposed at the bottom of the engine, but not along the axis of the crankshaft or the camshaft, wherein the oil pump is driven by the looped member.

The present invention satisfies the above-described needs by providing a four-cycle outboard motor having a crankshaft disposed substantially vertically within an engine, wherein rotation of this crankshaft is transmitted to a valve camshaft via an idler shaft and two looped members disposed at the bottom of the engine, and an oil pump disposed at the bottom of the engine, wherein the oil pump is driven by the idler shaft.

The four-cycle outboard motor, according to the present invention, is further characterized in that the idler shaft is reduced in rotational speed.

The present invention satisfies the above-described needs by providing a four-cycle outboard motor having a crankshaft disposed substantially vertically within an engine, wherein rotation of this crankshaft is transmitted to a valve camshaft via a looped member disposed at the bottom of the engine, and an oil pump disposed at the bottom of the engine but not along the axis of the crankshaft or the camshaft, wherein the oil pump and a tensioner of the looped member are disposed outside of the looped member in plan view. Here, the plan view may include a horizontal cross section at the bottom of the engine.

The present invention satisfies the above-described needs by providing a four-cycle outboard motor having a drive shaft linked to a crankshaft, wherein the crankshaft and the drive shaft are disposed such that their axes are offset from each other, and wherein the axis of the drive shaft is disposed toward the rear away from the axis of the crankshaft, that is, the drive shaft axis is located closer to the cylinder head than the crankshaft axis.

The four-cycle outboard motor, according to the present invention, further comprises a sprocket or pulley for driving the camshaft provided coaxially with the drive shaft.

The present invention satisfies the above-described needs by providing a four-cycle outboard motor having a crankshaft disposed substantially vertically within an engine, wherein rotation of this crankshaft is transmitted to a valve camshaft via a looped member disposed at the bottom of the engine, a drive shaft linked to the crankshaft, wherein the crankshaft and the drive shaft are disposed such that their axes are offset from each other and wherein the axis of the drive shaft is disposed toward the rear away from the axis of the crankshaft (i.e., the drive shaft axis is located closer to the cylinder head than the crankshaft axis.), a sprocket or pulley for driving the camshaft provided coaxially with the drive shaft, and an oil pump disposed coaxially with the crankshaft, wherein this oil pump is driven by the crankshaft.

The four-cycle outboard motor, according to the present invention, further comprises an oil intake passage and an oil discharge passage provided inside the engine so as to extend from the opposite sides of the engine toward the oil pump substantially at a right angle to the axis of the cylinder in plan view. Here, the plan view in the present description may include a horizontal corss section projected on the same plane.

DETAILED DESCRIPTION OF THE PREFERRED EMBODIMENTS

Embodiments of the present invention will now be described through reference to the figures.

Figure 1:
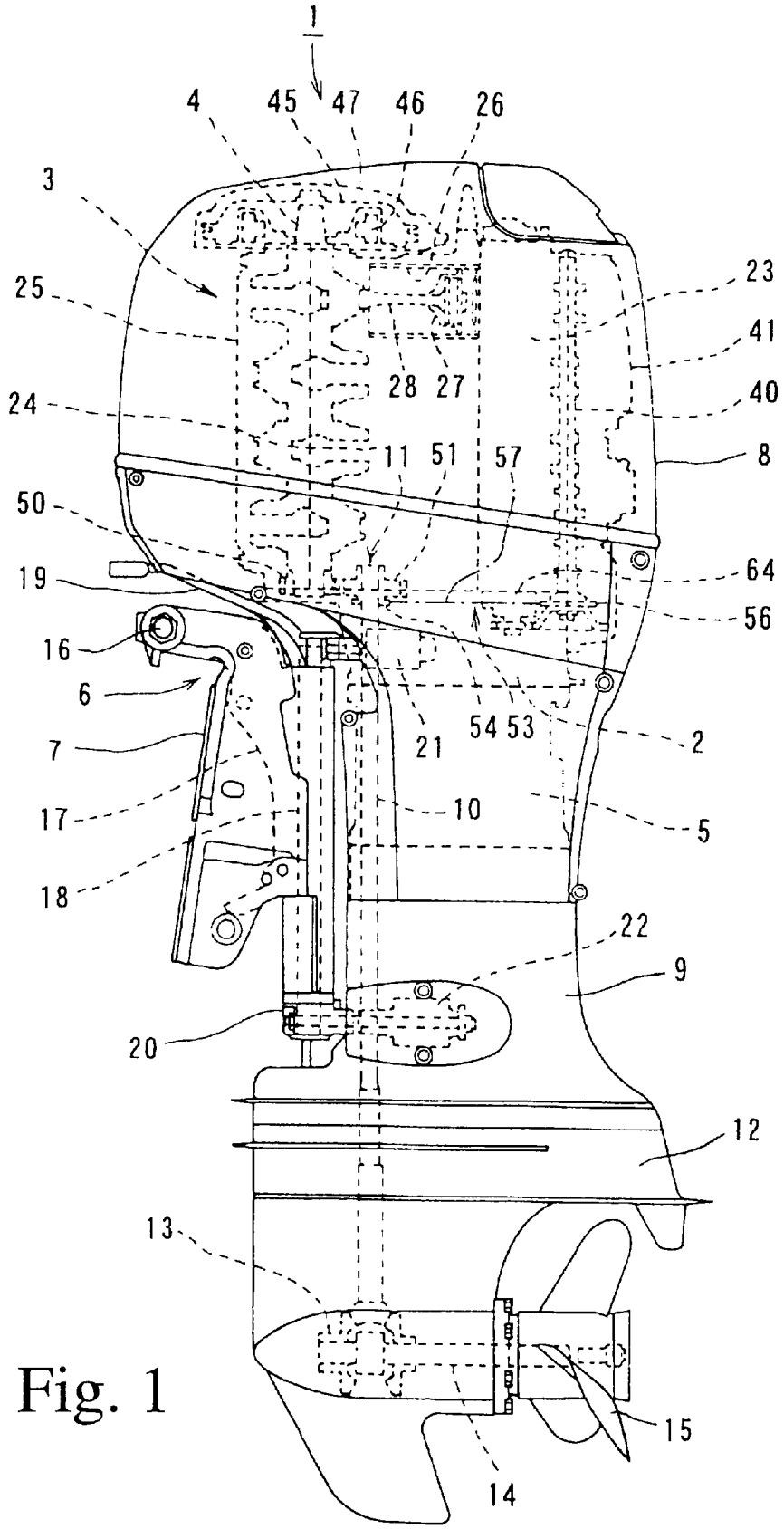
FIG. 1 is a left side view of a first embodiment of the four-cycle outboard motor according to the present invention.

FIG. 1 is a left side view of a first embodiment of an outboard motor to which this invention is applied. As shown in FIG. 1, this outboard motor 1 is equipped with an engine holder 2, and an engine 3 is mounted above this engine holder 2. This engine 3 is a vertical engine in which a crankshaft 4 is installed substantially vertically on the inside thereof.

An oil pan 5 is disposed beneath the engine holder 2, and a clamp bracket 7 is attached via a mounting apparatus 6 to the outboard motor 1, for example. The outboard motor 1 is mounted to the transom of a watercraft or hull (not shown) via this clamp bracket 7. An engine cowling (or cover) 8 covers the area around the engine 3, the engine holder 2, and the oil pan 5 of the outboard motor 1.

A drive shaft housing 9 is located at the bottom of the oil pan 5. A drive shaft 10 is disposed substantially vertically inside the engine holder 2, the oil pan 5 and the drive shaft housing 9, and the upper end thereof is linked to the lower end of the crankshaft 4 via a linking means 11. The drive shaft 10 extends downward through the drive shaft housing 9 and is designed to drive a propeller 15, which is the propulsion device, via a bevel gear 13 and propeller shaft 14 inside a gear case 12 provided at the bottom of the drive shaft housing 9.

A swivel bracket 17 is provided to the clamp bracket 7 via a tilt shaft 16, and a pilot shaft 18 is supported rotatably in the vertical direction inside this swivel bracket 17. An upper mounting bracket 19 and a lower mounting bracket 20, which double (or also serve) as steering brackets, are provided to the upper and lower ends of this pilot shaft 18 so that the whole assembly rotates integrally.

A pair of left and right upper mounting units 21 are provided to the front of the engine holder 2 and are linked to the upper mounting bracket 19. A pair of lower mounting units 22 are provided to the sides of the drive shaft housing 9 and are linked to the lower mounting bracket 20. The mounting apparatus 6 is configured as above, allowing the outboard motor 1 to be steered to the right and left around the pilot shaft 18 with respect to the clamp bracket 7, and to be trimmed upward (or tilted up) around the tilt shaft 16.

Figure 2:
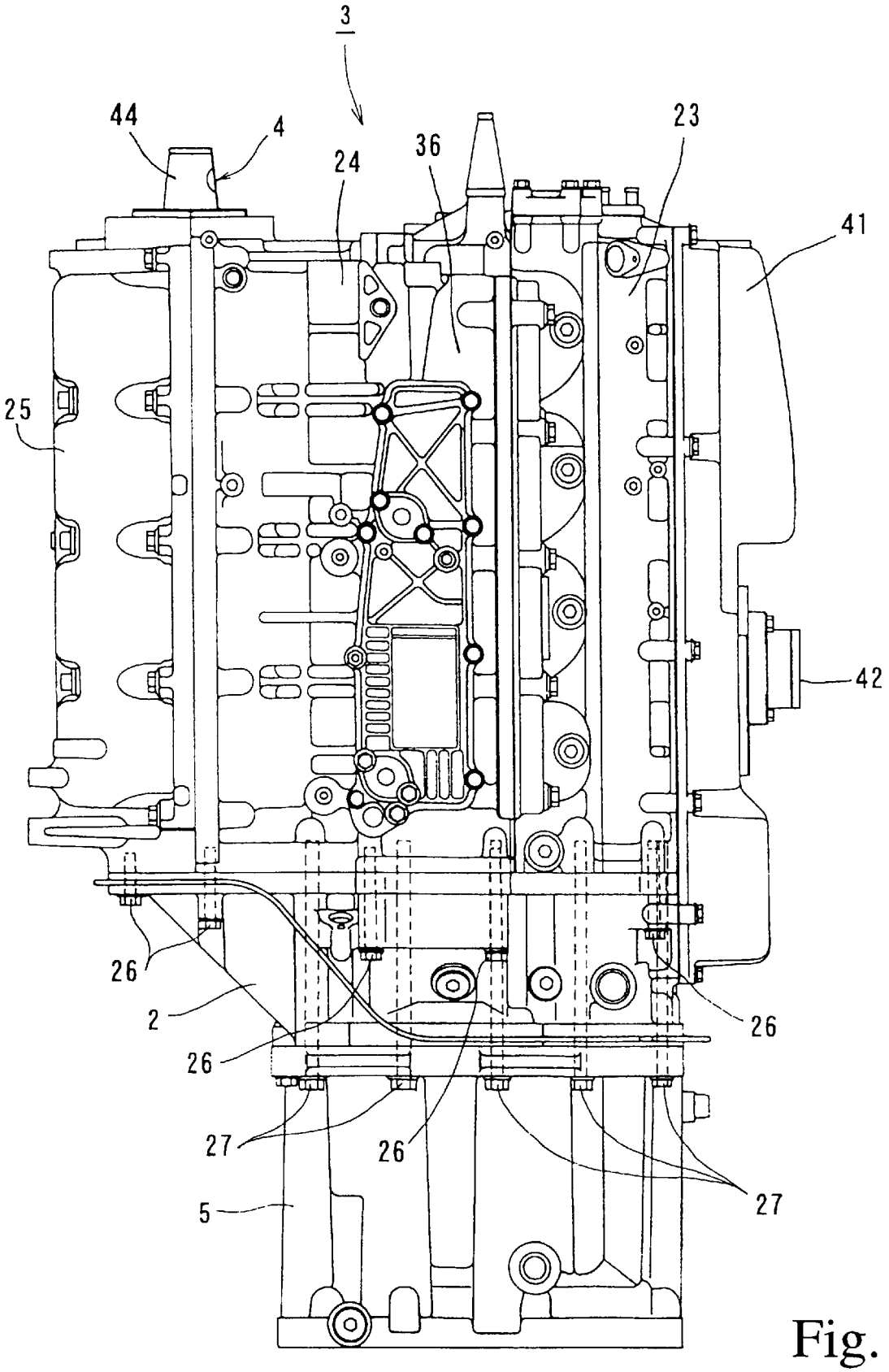
FIG. 2 is an enlarged left side view of the center portion of the outboard motor shown in FIG. 1.
Figure 3:
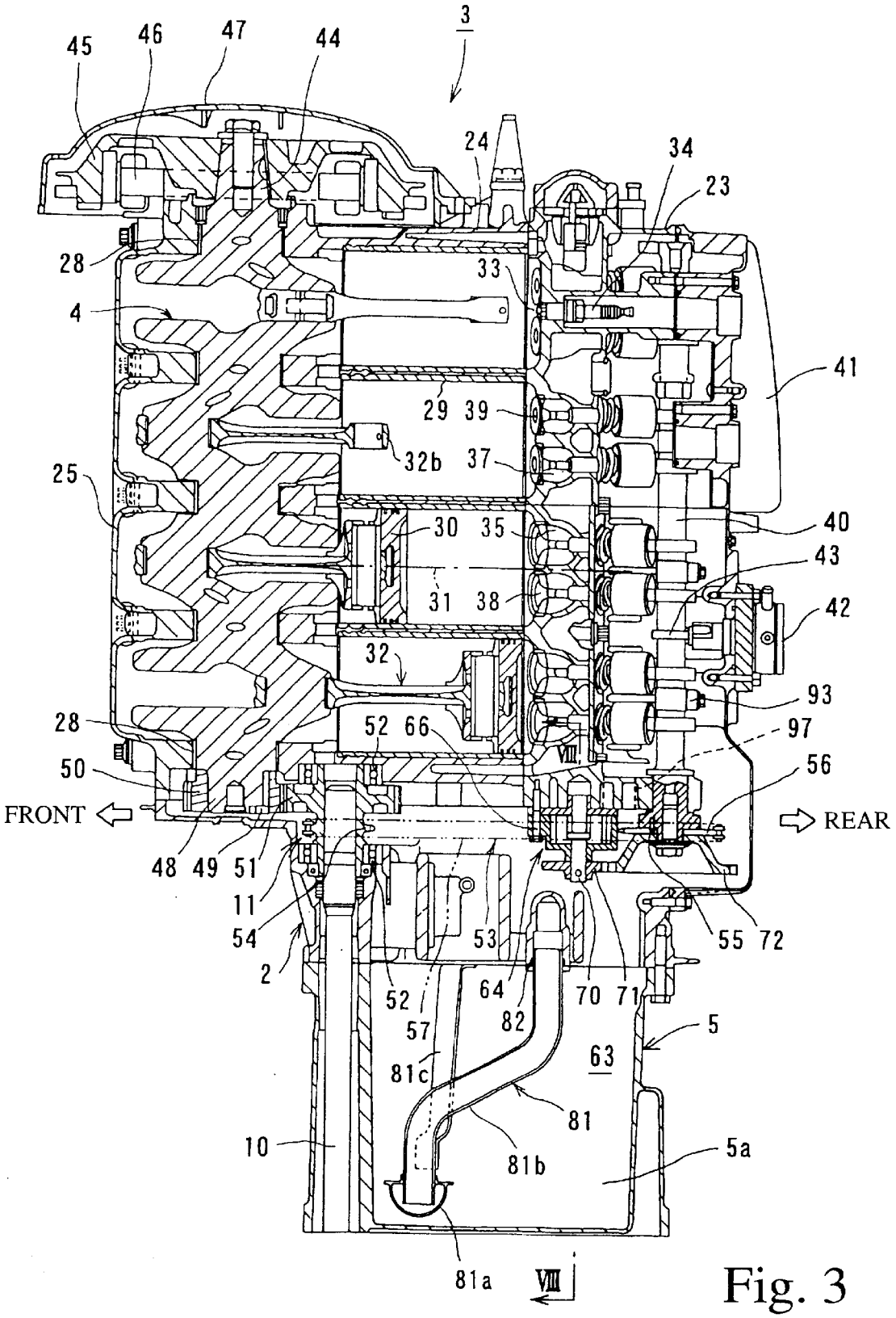
FIG. 3 is a vertical cross section of FIG. 2.

FIG. 2 is an enlarged left side view of the center portion of the outboard motor, and FIG. 3 is a vertical cross section of FIG. 2. As shown in FIGS. 2 and 3, the engine 3 installed in this outboard motor 1 is a water-cooled four-cycle inline engine comprising a combination of, for example, a cylinder head 23, a cylinder block 24, a crankcase 25 and so forth.

The cylinder block 24 is disposed behind crankcase 25 (i.e., on the right side in FIG. 2) which is disposed at the frontrnost part of engine 3 (i.e., at the leftmost side in FIGS. 2 and 3). Also, the cylinder head 23 is disposed behind the cylinder block 24.

As shown in FIG. 2, the lower surfaces of the cylinder head 23, the cylinder block 24 and the crankcase 25 are formed in the same plane, and the cylinder head 23, cylinder block 24 and crankcase 25 are all joined and fastened to the engine holder 2 by a plurality of bolts 26 from the lower surface of the engine holder 2.

A plurality of bolts 27 pass through the engine holder 2 from beneath the oil pan 5 disposed beneath the engine holder 2, and extend to the bottom of the cylinder head 23 and the cylinder block 24, for example, which fastens the engine holder 2 and the oil pan 5 to both cylinder head 23 and cylinder block 24.

As mentioned above, the crankshaft 4 is supported substantially vertically at the mating surface between the crankcase 25 and the cylinder block 24 via a plurality of metal bearings 28, for example. Four cylinders 29 facing substantially horizontally are formed in a vertical row within the cylinder block 24, and pistons 30 are inserted in the cylinders 29 such that they are able to slide in the axial direction along the axes of the cylinders 29. The crankshaft 4 is linked to the pistons 30 by connecting rods 32, and the reciprocal strokes of the pistons 30 are converted into rotary motion of the crankshaft 4.

A combustion chamber 33 corresponding to each cylinder 29 is formed in the cylinder head 23, and a spark plug 34 is connected thereto from the outside thereof. Also formed in the cylinder head 23 are an intake port 37 that leads to the combustion chamber 33 and an exhaust port 35 that leads to an exhaust passage 36 formed on the left side of the cylinder block 24 and the engine holder 2. An intake valve 39 and an exhaust valve 38 for opening and closing the ports 35 and 37 are also disposed inside the cylinder head 23, and two valve camshafts (one for intake and one for exhaust) for opening and closing these valves 38 and 39 are disposed parallel to the crankshaft 4 and at the rear part of the cylinder head 23.

The cylinder head 23 is covered by a cylinder head cover 41. A mechanical fuel pump 42 is disposed on this cylinder head cover 41, and the fuel pump 42 is driven by a cam 43 provided on the camshaft 40.

As shown in FIG. 3, the upper end of the crankshaft 4 protrudes above the crankcase 25 and the cylinder block. This protruding portion 44 is provided with a flywheel 45 and a generating magnet apparatus 46, and these are covered by a magnet cover 47.

Figure 4:
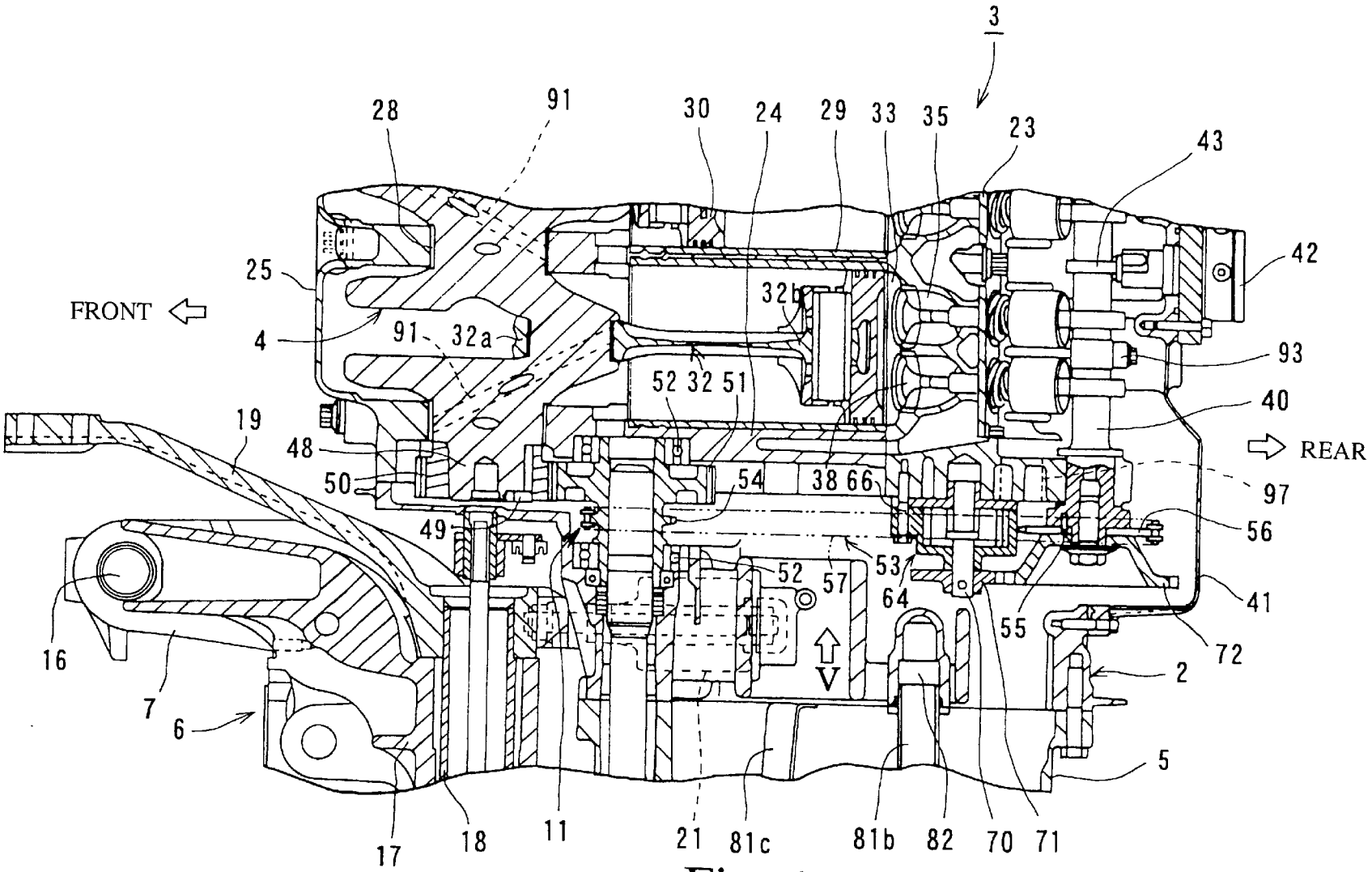
FIG. 4 is an enlarged vertical cross section of the engine holder shown in FIG. 3 and its surrounding components.
Figure 5:
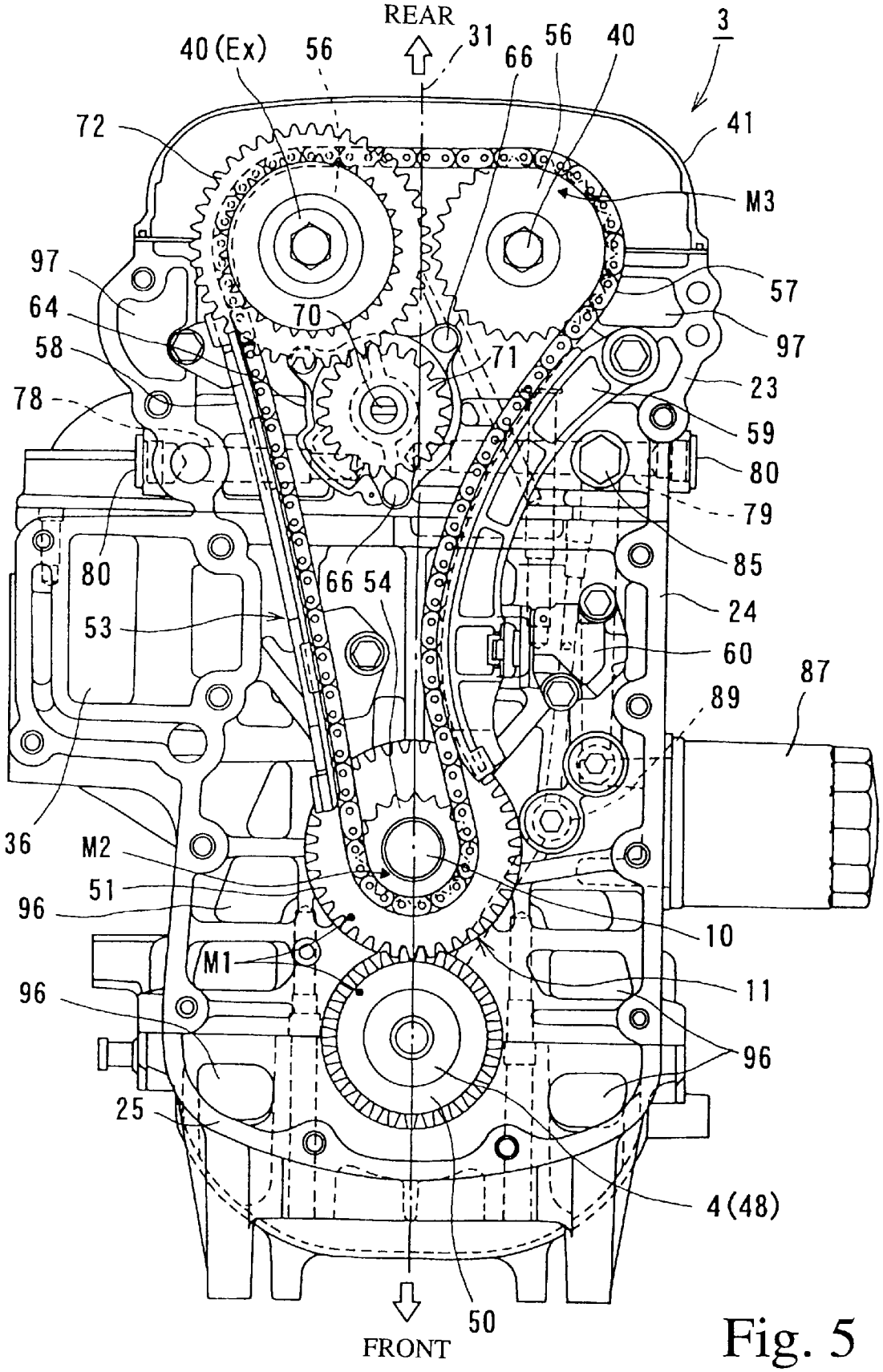
FIG. 5 is a view of FIG. 4 in the direction of arrow V.

FIG. 4 is an enlarged vertical cross section of the engine holder 2 and its surrounding components shown in FIG. 3, and FIG. 5 is a view of FIG. 4 in the direction of arrow V, that is, a bottom view of the engine 3. As shown in FIGS. 3 to 5, the crankshaft 4 and the drive shaft 10 are disposed such that their axes are offset from each other. As shown in detail in FIG. 5, the shaft centers of the crankshaft 4 and the drive shaft 10 are aligned on the axis 31 of the cylinder 29, for example, and the axis of the drive shaft 10 is disposed such that it is offset toward the rear (i.e., toward the cylinder head 23) away from the axis of the crankshaft 4.

The lower end of the crankshaft 4 protrudes from the bottom of the engine 3. A crank gear 50 that is phase-matched by a knock pin 49 is press fitted onto this protruding portion 48. The linking means 11 is, for example, spline-fitted coaxially with the drive shaft 10 to the upper end of the drive shaft 10 protruding above the engine holder 2. A driven gear 51 that meshes (or engages) with this crank gear 50 is formed integrally with this linking means 11. The upper and the lower ends of this linking means 11 are supported by the cylinder block 24 and the engine holder 2, respectively, via ball bearings 52, for example.

When the crankshaft 4 rotates, the rotational force thereof is transmitted from the crank gear 50 to the driven gear 51 so that the drive shaft 10 is rotationally driven. Although not shown in detail, the crank gear 50 and driven gear 51 are "helical gears," for example, and there is a torsional direction such that thrust is generated upward for the crankshaft 4 and downward for the drive shaft 10 when the engine 3 rotates forward. The number of teeth of the driven gear 51 is set greater than the number of teeth of the crank gear 50, so the drive shaft 10 is rotationally driven at a lower speed than the crankshaft 4. Phase-matching marks M1 of the gears 50 and 51 are provided on the lower sides (the engine holder 2 sides) of the crank gear 50 and the driven gear 51.

A camshaft drive mechanism 53 for transmitting the rotation of the crankshaft 4 to the camshafts 40 so as to rotationally drive the camshafts 40 is provided in the space between the bottom of the engine 3 and the top surface of the engine holder 2. This camshaft drive mechanism 53 is a chain-drive system, for example, and comprises a timing sprocket 54 for driving the camshafts 40 and formed integrally with the linking means 11 beneath the driven gear 51 formed on the linking means 11, a pair of left and right (intake and exhaust) cam sprockets 56 matched in phase by a knock pin 55 and provided integrally rotatably to the lower ends of the two camshafts 40 protruding from the lower surface of the engine 3, and a single timing chain 57 (looped member) that is looped (or wrapped) around these sprockets 54 and 56. The ratio of the number of teeth on the timing sprocket 54 to the number of teeth on the cam sprockets 56 is set to be less than 1 to 2. The numbers of teeth of the various gears and sprockets are set so that the rotational speed ratio of the crankshaft 4 and the camshafts 40 will ultimately be 2 to 1.

The oscillation and tension of the timing chain 57 are constantly maintained in a suitable state by a chain guide 58 and a chain tensioner 59 provided to the lower surface of the engine 3. The chain guide 58 is disposed on the taut side (exhaust side) of the timing chain 57, and is fixed straddling the lower surfaces of the cylinder head 23 and the cylinder block 24.

The chain tensioner 59 is disposed on the slack side (intake side) of the timing chain 57 and one end thereof is rotatably supported on the lower surface of the cylinder head 23. A tensioner adjuster 60 provided to the lower surface of the cylinder block 24 outside the timing chain 57 hydraulically presses the chain tensioner 59 against the timing chain 57 so that the tension of the timing chain 57 may be adjusted. Here, the tensioner adjuster 60 may belong to a device to adjust tension or a tension adjuster. An alignment mark M2 for the timing chain 57 is provided to the surface on the lower side (the engine holder 2 side) of the timing sprocket 54. An alignment mark M3 for the timing chain 57 is similarly provided to the surface on the lower side (the engine holder 2 side) of the cam sprockets 56.

In the above embodiment, the camshaft drive mechanism 53 comprises the timing sprocket 54 provided to the linking means 11, the cam sprockets 56 provided to the camshafts 40, and the timing chain 57 looped (or wrapped)around these sprockets 54 and 56. However, a pulley (not shown) may be used instead of each sprocket 54, 56. A timing belt (not shown) may be used instead of the timing chain 57.

This outboard motor 1 is equipped with a lubrication apparatus 63 for lubricating the internal parts of the engine 3. This lubrication apparatus 63 draws up lubricating oil contained in the oil pan 5 with the oil pump 64 so as to supply it to the engine 3. The lubrication apparatus 63 is configured as described below.

Figure 6:
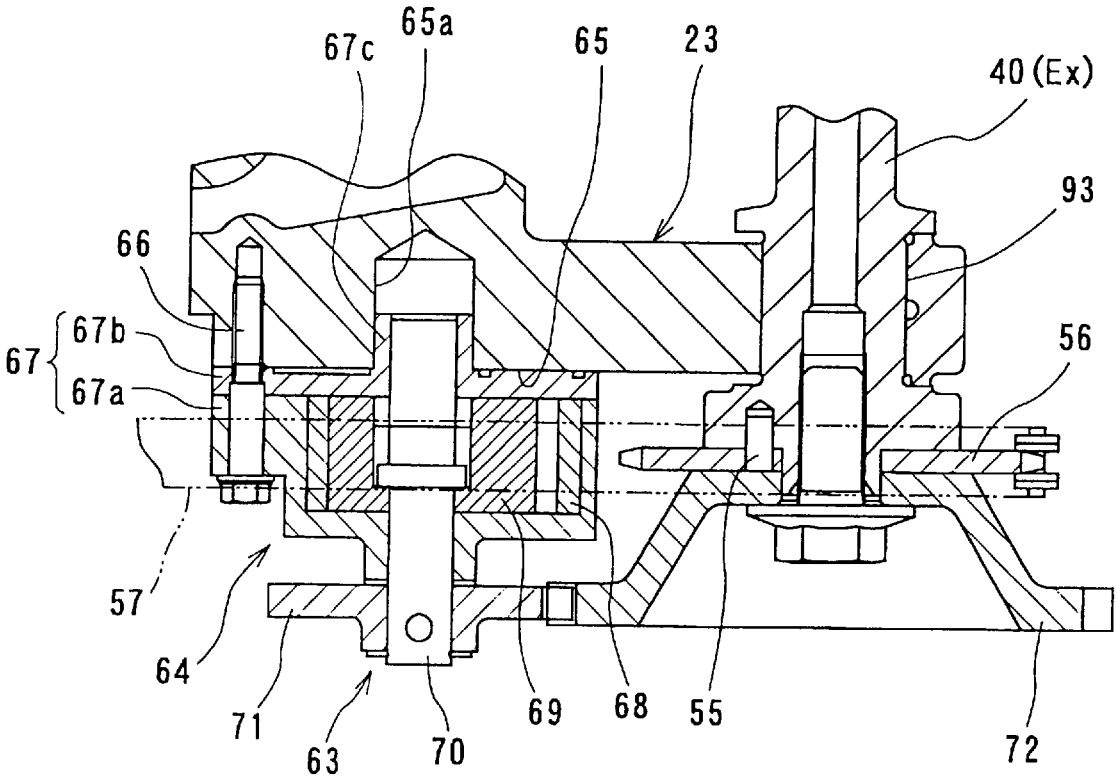
FIG. 6 is an enlarged cross section of the oil pump and its surrounding components.
Figure 7:
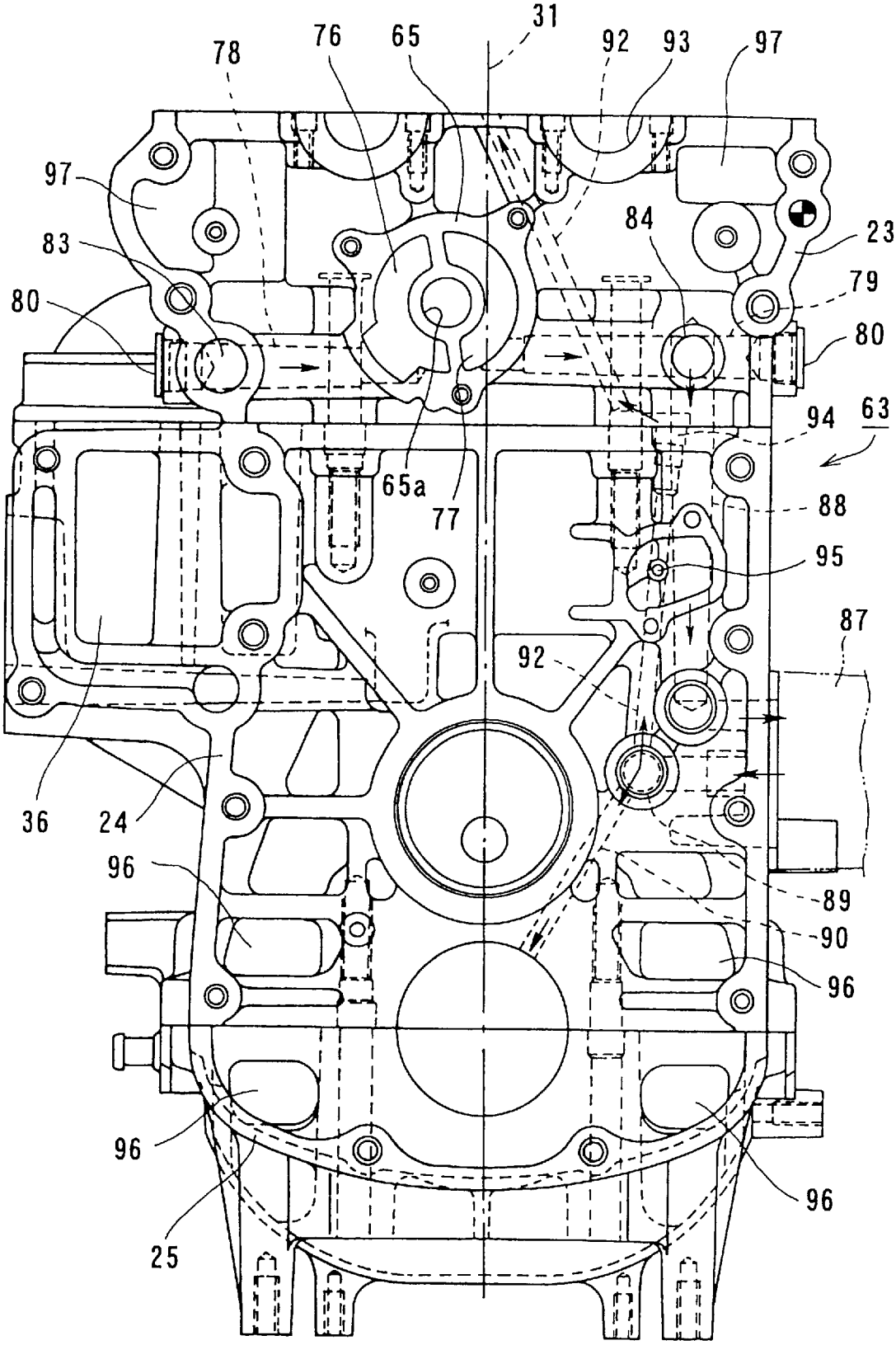
FIG. 7 is a bottom view of the engine when the camshaft drive mechanism, etc., have been removed from the lower surface of the engine.
Figure 8:
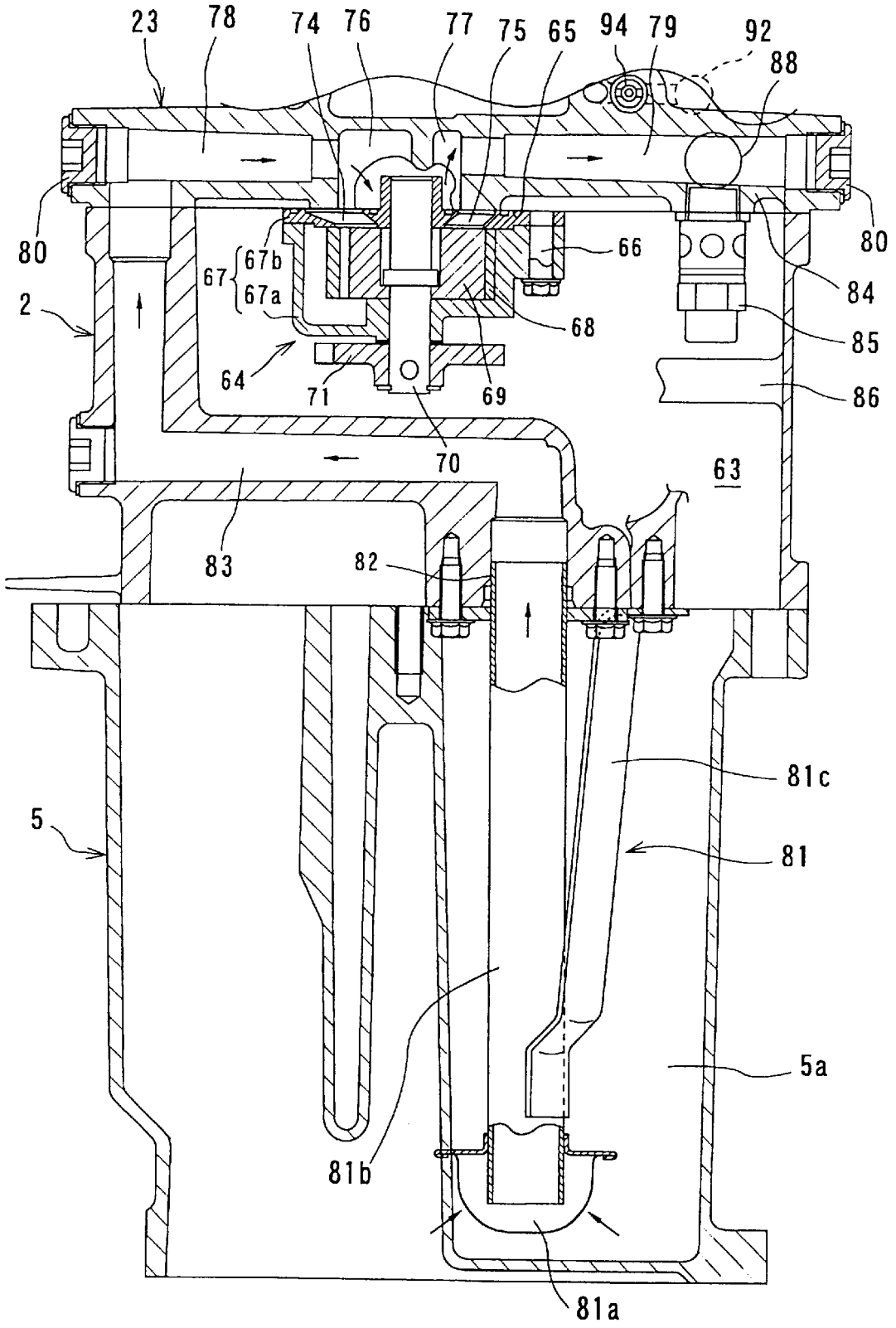
FIG. 8 is a cross section along the VIII—VIII line in FIG. 3.
Figure 9:
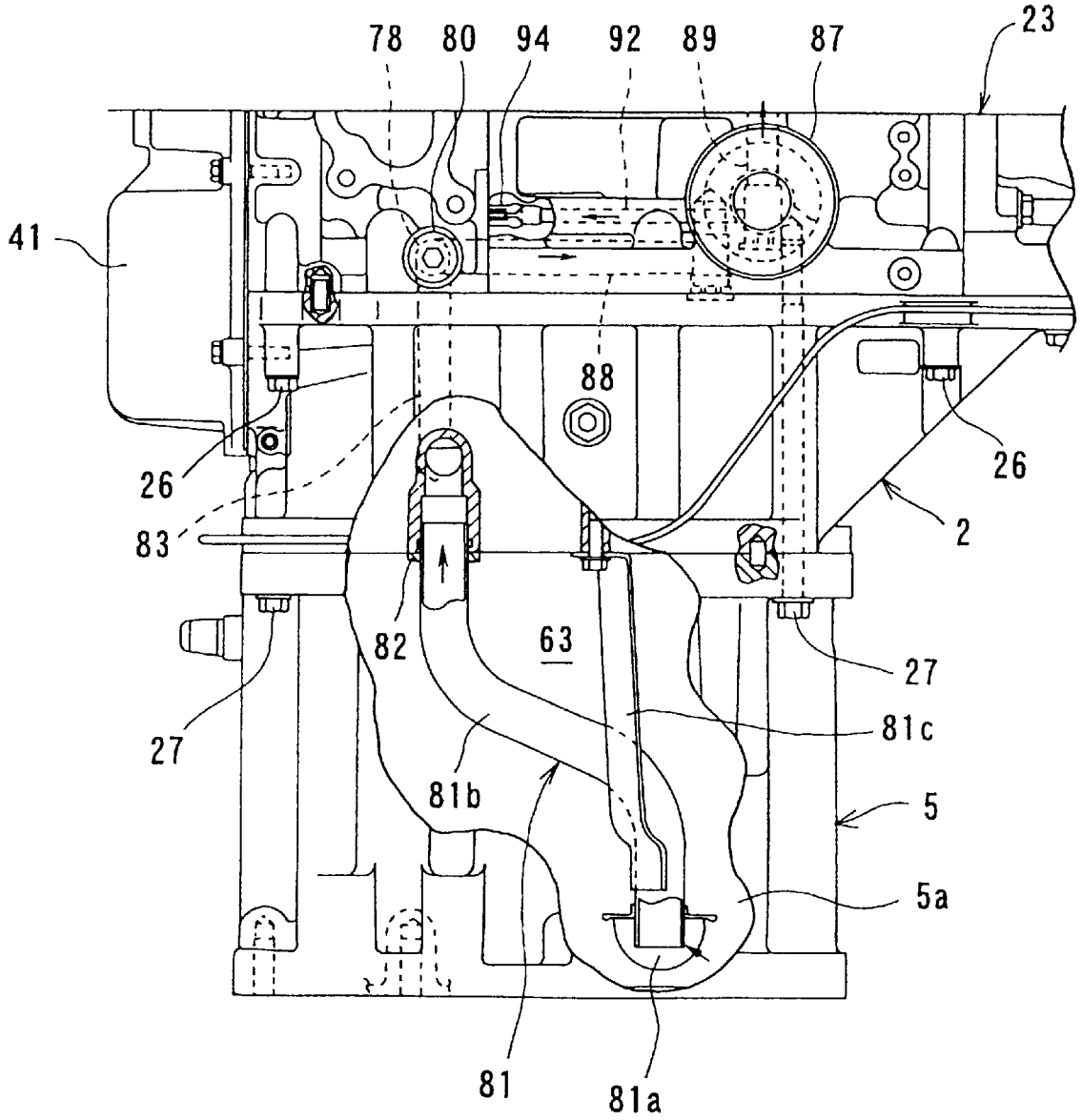
FIG. 9 is a right side view of the engine bottom, the engine holder, and the oil pan.

FIG. 6 is an enlarged cross section of the oil pump 64 and its surrounding components, and FIG. 7 is a bottom view of the engine 3 when the camshaft drive mechanism 53, etc., have been removed from the lower surface of the engine 3. FIG. 8 is a cross section along the VIII—VIII line in FIG. 3, and FIG. 9 is a right side view of the engine 3 bottom, the engine holder 2 and the oil pan 5.

A pump attachment flange surface 65 is formed within the space encircled by the timing chain 57 on the lower surface of the cylinder head 23. The oil pump 64 is fixed to this pump attachment flange surface 65 by three bolts 66, for example.

The oil pump 64 is a common trochoid pump, for example, comprising a pump case 67 composed of a cupshaped case body 67*a* that opens upward and a flat case cap 67*b*, an outer rotor 68 and an inner rotor 69 enclosed in this pump case 67, and a pump drive shaft 70.

The case body 67*a* and the case cap 67*b* of the pump case 67 are fastened to the pump attachment flange surface 65 of the cylinder head 23 by the bolts 66. The pump drive shaft 70 passes vertically through the pump case 67, and its lower end protrudes below the oil pump 64. A pump driven gear 71 is provided to the protruding end of the pump drive shaft 70. A pump drive gear 72 (the oil pump drive apparatus) is provided integrally rotatably with the exhaust cam sprocket 56 to the lower end of one of the two camshafts 40 (in this embodiment, the exhaust camshaft 40 (Ex)). This pump drive gear 72 is operationally linked to the pump driven gear 71.

The number of teeth of the pump drive gear 72 is set greater than the number of teeth of the pump driven gear 71 so that the pump drive shaft 70 rotates at a higher speed than the camshafts 40.

Meanwhile, the inner rotor 69 is integrally rotatably provided in the middle part of the pump drive shaft 70. The outer rotor 68 is eccentric with respect to the inner rotor 69. The outer-toothed shape (not shown) formed around the exterior of the inner rotor 69 meshes (or engages) with the inner-toothed shape (not shown) formed around the interior of the outer rotor 68 like an internal gear system.

An intake hole 74 and a discharge hole 75 are formed in the case cap 67*b* across the pump drive shaft 70. An intake port 76 and a discharge port 77 are formed and attached to the pump attachment flange surface 65 of the cylinder head 23 so that each port may be aligned to each corresponding hole 74, 75. A female component 65*a* (like socket) that engages with a male component 67*c* (like spigot) of the case cap 67*b* is formed on the pump attachment flange surface 65 for positioning the oil pump 64. As shown in FIG. 4, the pump attachment flange surface 65 is in the same plane as the interface between the cylinder head 23 and the engine holder 2. The oil pump 64 is disposed at such height that the oil pump 64 overlaps with the timing chain 57 if viewed from the side.

In the present embodiment, the oil pump 64 is small enough that it may be positioned inside of the timing chain 57 without interfering with the timing chain positioned in a similar height as shown in FIG. 4. On the other hand, the tensioner adjuster 60 is disposed outside of the timing chain 57 at the bottom of the engine as described before. Thus, the oil pump 64 is disposed inside of the timing chain 57 while the tensioner adjuster 60 is disposed outside of the timing chain 57 as shown in FIG. 5. That is, the oil pump 64 is disposed inside the timing chain 57 while the tensioner adjuster 60 is disposed outside the timing chain 57 in plan view.

Inside the cylinder head 23, an oil intake passage 78 extends from one side (left side in FIG. 8) to the intake port 76 connected to the pump attachment flange surface 65 substantially perpendicular to the axis 31 of the cylinder 29 in plan view. An oil discharge passage 79 extends from the other side (right side in FIG. 8) to the discharge port 77 connected to the pump attachment flange surface 65 substantially perpendicular to the axis 31 of the cylinder 29 in plan view. Openings for the above-mentioned intake and discharge passages on left and right sides, respectively, of the cylinder head 23 are stopped by plugs 80.

As shown in FIG. 8, an oil strainer 81 is fixed to the lower surface of the engine holder 2. A strainer port 82 is formed on the lower surface of the engine holder 2. The downstream end of the oil strainer 81 is connected to the strainer port 82.

The oil strainer 81 comprises a strainer component 81*a* that serves as an intake port for lubricating oil, a strainer pipe 81*b* that extends upward drawing an approximately S-shaped curve from the strainer component 81*a*, and a brace 81*c* that similarly extends upward from the strainer component 81*a*.

Most of the space inside the oil pan 5 is used for an oil sump 5*a*, which may be filled with lubricating oil. The strainer component 81*a* of the oil strainer 81 is designed to be submerged at the bottom of the oil sump 5*a* when the oil pan 5 is fixed to the lower surface of the engine holder 2.

An oil introduction passage 83 extending from the strainer port 82 toward the oil intake passage 78 is formed in the engine holder 2, and the lubricating oil in the oil sump 5*a* is guided to the oil introduction passage 83.

Meanwhile, a relief valve seat 84 is provided directly below the oil discharge passage 79 at the lower surface of the cylinder head 23, and a relief valve 85 is screwed substantially vertically to this relief valve seat 84 from below. This relief valve 85 serves to keep the pressure constant inside the oil discharge passage 79. When the relief valve 85 opens, any excess lubricating oil is discharged into the engine holder 2 and recovered by the oil sump 5*a* in the oil pan 5. As shown in FIG. 8, a rib 86 that prevents the relief valve 85 from falling is provided directly below the relief valve 85 in the engine holder 2.

An oil filter 87 is disposed on the lower right side of the cylinder block 24. The lubricating oil inside the oil discharge passage 79 reaches the oil filter 87 via an oil passage 88 formed in the cylinder block 24. The lubricating oil filtered inside the filter is then directed to a main gallery 89 formed in the cylinder block 24.

Part of the lubricating oil directed to the main gallery 89 is further directed through a branch passage 90 to the metal bearings 28 supporting the crankshaft 4. The lubricating oil directed to the metal bearings 28 is, after lubricating the sliding interface of the crankshaft 4 and the metal bearings 28, further directed via an oil passage 91 formed in the crankshaft 4 (see FIG. 4) to the big ends 32*a* of the connecting rods 32 so that it may lubricate the sliding interface of the crankshaft 4 and the big ends 32*a* of the connecting rods 32.

The lubricating oil is discharged from oil jets (not shown) in the connecting rods 32 toward the back side of the pistons 30, so as to lubricate the insides of the cylinders 29 and the little ends 32*b* of the connecting rods 32 and also to cool the pistons 30.

Meanwhile, part of the lubricating oil sent (or directed) to the main gallery 89 goes through a branch passage 92 and reaches the cylinder head 23, where it lubricates the bearing components 93 of the camshafts 40 (see FIG. 4). A venturi plug 94 is provided at a point along this branch passage 92, and regulates the amount of lubricating oil sent to the cylinder head 23. An oil passage 95 that supplies hydraulic fluid to the above-mentioned tensioner adjuster 60 is formed at a point along this branch passage 92 upstream from the venturi plug 94 (see FIG. 7).

The lubricating oil that has been sent (or directed) to the crankcase 25 and the cylinder block 24 and has lubricated the various components thereof runs down through the engine holder 2 and is recovered in the oil pan 5 from a plurality of oil drain holes 96 formed in the lower surfaces of the crankcase 25 and the cylinder block 24. These oil drain holes 96 are disposed at suitable locations away from moving parts such as the timing chain 57, driven gear 51 and crank gear 50 so that the lubricating oil will not come into contact with and be heated by these moving parts as it runs down.

The lubricating oil that has been sent into the cylinder head 23 and has lubricated the various components thereof runs down through the engine holder 2 and is recovered in the oil pan 5 from a plurality of oil drain holes 97 formed in the lower surface of the cylinder head 23. These oil drain holes 97 are disposed at suitable locations away from moving parts such as the timing chain 57, cam sprockets 56, pump drive gear, and pump driven gear 71 so that the lubricating oil will not come into contact with and be heated by these moving parts as it runs down.

The operation of this embodiment will now be described.

When the engine 3 is started, the crankshaft 4 rotates and the drive shaft 10 is driven via the linking means 11. The rotation of the linking means 11 drives the camshafts 40 via the timing chain 57, opens and closes the intake valves 39 and the exhaust valves 38, and drives the fuel pump 42.

The oil pump 64 is driven by the rotation of the camshaft 40, whereby the lubricating oil inside the oil pan 5 is sent under pressure to the engine 3.

Since the oil pump 64 is disposed inside (in plan view) of the timing chain 57 (the looped member) wrapped around the timing sprocket 54 and the cam sprockets 56 provided to the lower surface of the engine 3, and since the tensioner adjuster 60, which is used for the operation of the chain tensioner 59 that keeps the timing chain 57 taut, is disposed outside of the timing chain 57, the structure is simplified and a planar size of projected engine 3 on the plane becomes smaller so that the outboard motor 1 may be made more compact. Also, the reliability of the camshaft drive mechanism 53 and the lubrication apparatus 63 is enhanced since the various members do not interfere with the exhaust passage 36, for example.

The disposition of the oil pump 64 and the tensioner adjuster 60 may also be reversed from the above, that is, the tensioner adjuster 60 may be disposed inside (in plan view) of the timing chain 57 and the oil pump 64 may be disposed outside of the timing chain 57. The reverse configuration may achieve a similar goal.

Furthermore, by disposing the oil pump 64 at a location where it overlaps the timing chain 57 if viewed from the side, greater layout flexibility may be accomplished so that the overall height of the engine 3 may be lowered to lead a more compact outboard motor 1.

Meanwhile, since the pump drive gear 72, which is the oil pump drive apparatus, is provided to the lower end of the camshaft 40 such that it rotates integrally with the cam sprockets 56, and since the pump drive shaft 70 of the oil pump 64 is driven by this pump drive gear 72, the entire engine 3 may not have to be moved upward, that is, it may not have to be disposed at a high position so that the outboard motor 1 can be more compact.

Also, since the number of teeth on the pump drive gear 72 is set greater than the number of teeth on the pump driven gear 71 attached integrally rotatably to the pump drive shaft 70 so that the pump drive shaft 70 rotates at a higher speed than the camshafts 40, a smaller oil pump 64 may be utilized. Thus, greater layout flexibility at the bottom of the engine 3 (e.g., disposing the smaller oil pump in a smaller space) may be achieved and the outboard motor 1 may eventually be made more compact and lightweight, which may lead to cost reduction.

Since the oil pump 64 is disposed on the cylinder head 23 and since the tensioner adjuster 60 is disposed on the cylinder block 24, no high-pressure oil passage (i.e., no oil passage with highly-pressured oil) is present on the lower surface of the engine 3 facing the engine holder 2. Therefore, it becomes easier to seal the mating surface between the engine 3 and the engine holder 2, resulting in a simplified construction and increased reliability of the engine 3.

If the oil intake passage 78 and the oil discharge passage 79, which extend from the left and the right sides of the cylinder head 23 (in FIG. 8) toward the intake port 76 and discharge port 77, respectively, of the pump attachment flange surface 65, are provided inside the cylinder head 23 substantially perpendicular to the axis 31 of the cylinder 29, no complicated oil passage is needed thus avoiding difficult machining, lowering the machining cost, and affording greater layout flexibility, resulting in the more compact outboard motor 1.

Meanwhile, aligning the shaft centers of the crankshaft 4 and the drive shaft 10 on the axis 31 of the cylinders 29 in plan view, for example, and disposing the shaft center of the drive shaft 10 offset toward the rear (i.e., toward the cylinder head 23) away from the shaft center of the crankshaft 4, creates a space directly beneath the crankshaft 4 and in front of the engine holder 2 and the oil pan 5. Thus, the mounting apparatus 6 comprising the swivel bracket 17, the pilot shaft 18, etc., may be disposed in this space so that the overall fore-and-aft length of the outboard motor 1 can be shortened, resulting in the more compact outboard motor 1.

The ratio of the number of teeth on the timing sprocket 54 to the number of teeth on the cam sprockets 56 can be set lower than 1 to 2 without using an intermediate member such as an idler shaft or idler gear (used in the prior art) since the timing sprocket 54 (for driving the camshafts) is provided coaxially with the drive shaft 10 to the linking means 11 that operationally links the crankshaft 4 to the drive shaft 10, which is disposed offset from this crankshaft 4 closer to the cylinder head 23. As a result, it is possible to reduce the size (diameter) of the cam sprockets 56, which allows smaller planar sizes of the cylinder head 23 and the cylinder head cover 41.

The above embodiment is an example of applying the present invention to an inline four-cylinder engine 3, but the present invention may be applied to any number of cylinders. Furthermore, the present invention may be applied to a so-called V-type engine in which a plurality of cylinders are arranged in a V-shape in plan view.

The above embodiment is also an example of applying the present invention to an outboard motor 1 in which the crankshaft 4 and the drive shaft 10 are offset from each other, but the present invention can also be applied to a conventional type of outboard motor in which the crankshaft 4 and the drive shaft 10 are connected coaxially.

The oil pump 64 used in the engine 3 in this embodiment is driven by the rotation of the camshafts 40 transmitted via gears, but the oil pump 64 may instead be driven by the timing chain 57 that rotates the camshafts 40. An embodiment thereof will be described below through reference to FIGS. 10 to 14.

Figure 10:
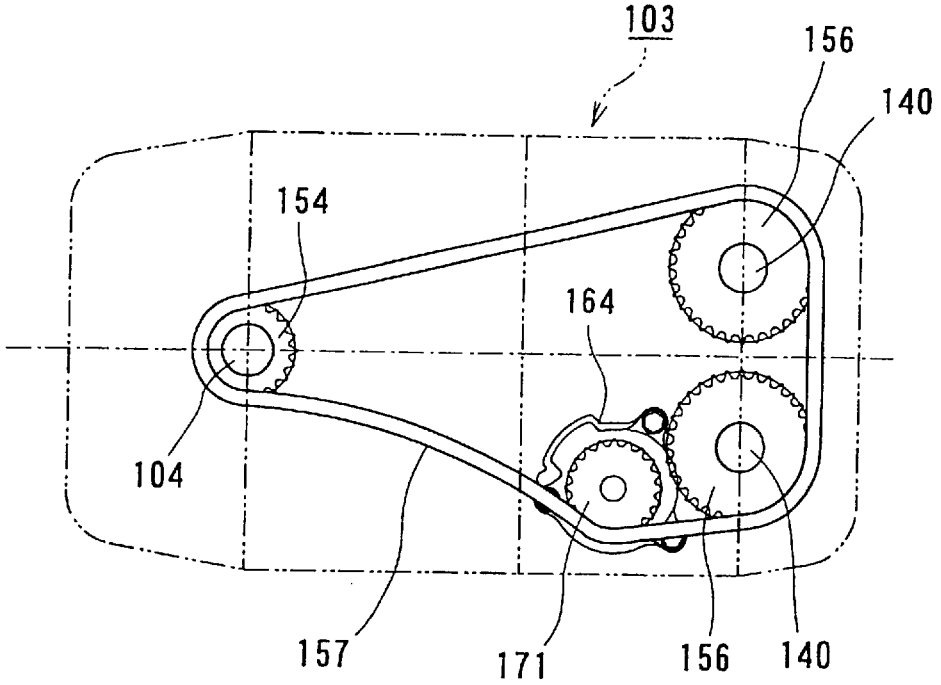
FIG. 10 is a simplified diagram of the camshafts and the oil pump drive mechanism in a second embodiment of the present invention.

FIG. 10 is a simplified diagram of camshafts and an oil pump drive mechanism in a second embodiment according to the present invention. With an engine 103 in FIG. 10, a timing sprocket 154 is provided to a crankshaft 104, cam sprockets 156 are provided to two camshafts 140, a pump driven gear 171 is provided to an oil pump 164, and a timing chain 157 is looped around these sprockets 154 and 156 so as to drive the oil pump 164 with the rotation of the crankshaft 104.

Figure 11:
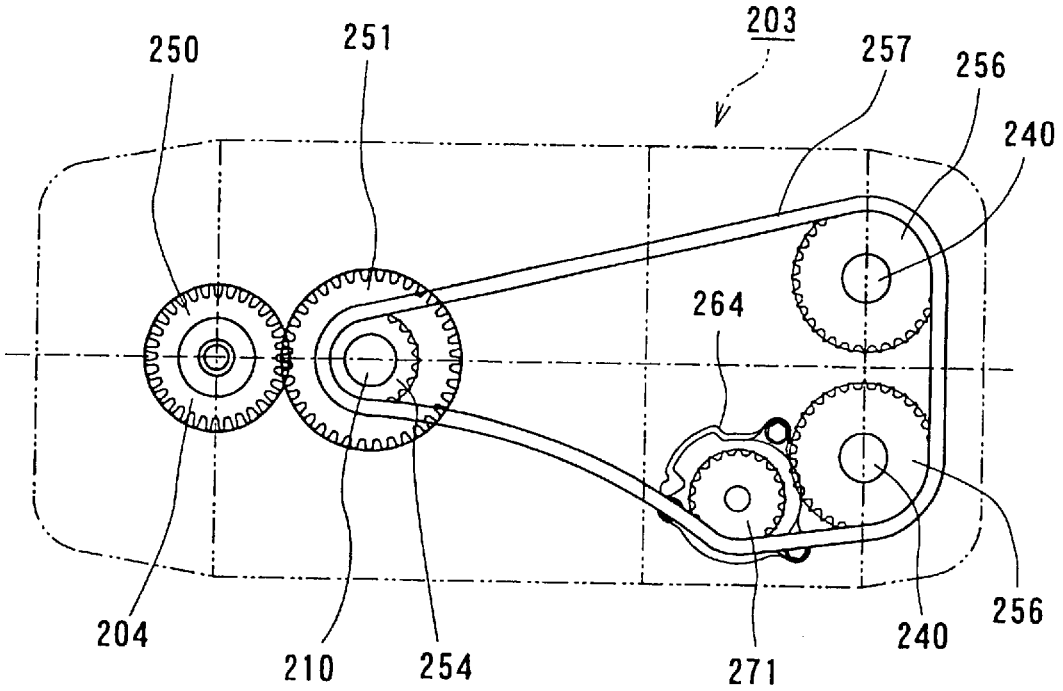
FIG. 11 is a simplified diagram of the camshafts and the oil pump drive mechanism in a third embodiment of the present invention.

FIG. 11 is a simplified diagram of camshafts and an oil pump drive mechanism in a third embodiment according to the present invention. With an engine 203 in FIG. 11, a crank gear 250 is provided to a crankshaft 204, and a driven gear 251 that meshes with the crank gear 250 is provided to a drive shaft 210 that is offset from this crankshaft 204. Also, a timing sprocket 254 is provided coaxially with the driven gear 251 to the drive shaft 210, cam sprockets 256 are provided to two camshafts 240, a pump driven gear 271 is provided to an oil pump 264, and a timing chain 257 is looped around these sprockets 254 and 256 so as to drive the oil pump 264 with the rotation of the crankshaft 204.

Figure 12:
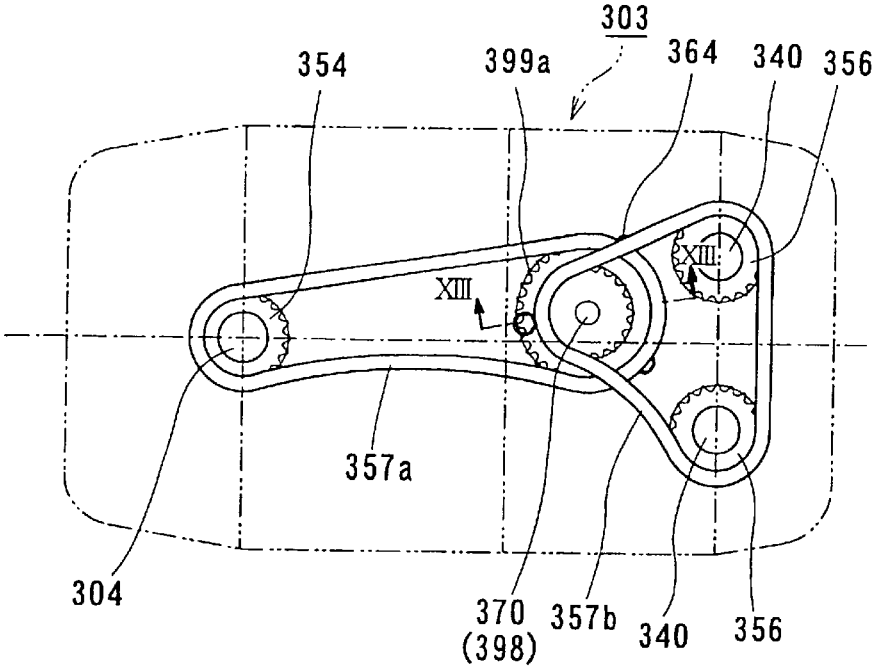
FIG. 12 is a simplified diagram of the camshafts and the oil pump drive mechanism in a fourth embodiment of the present invention.
Figure 13:
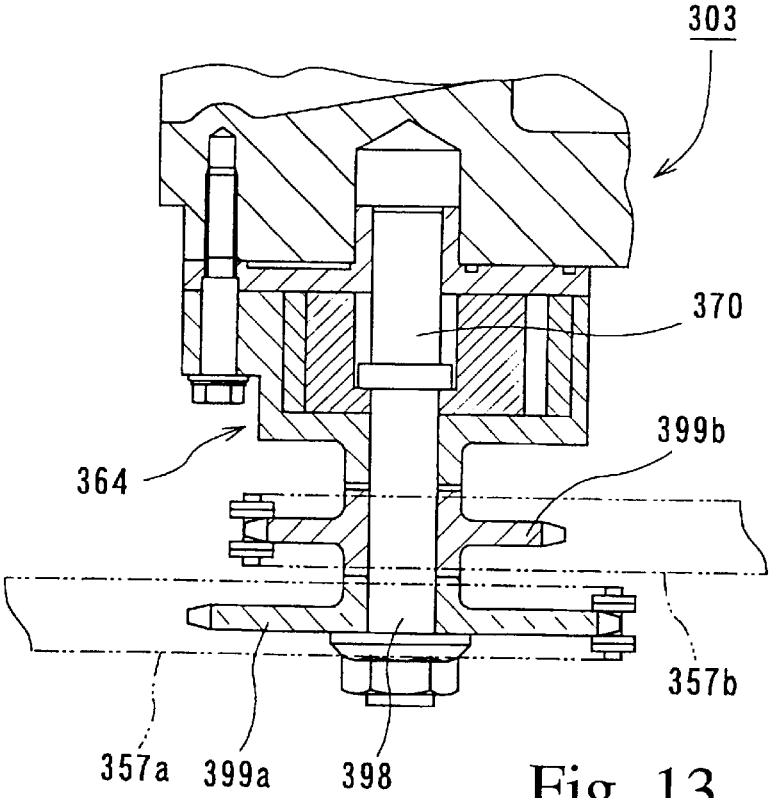
FIG. 13 is a cross section along the XII—XII line in FIG. 12.

FIG. 12 is a simplified diagram of camshafts and an oil pump drive mechanism in a fourth embodiment according to the present invention. With an engine 303 in FIG. 12, an idler shaft 398 is provided between a crankshaft 304 and two camshafts 340. Also, a timing sprocket 354 is provided to the crankshaft 304, two idler sprockets 399*a* and 399*b* are provided to the idler shaft 398, and a first timing chain 357*a* is looped around the idler sprocket 399*a* and the timing sprocket 354. Cam sprockets 356 are provided to two camshafts 340, and a second timing chain 357*b* is looped around the idler sprocket 399*b* and the cam sprockets 356. As shown in FIG. 13, the idler shaft 398 functions as a pump drive shaft 370 of the oil pump 364, and the oil pump 364 is driven by the rotation of the crankshaft 304.

Figure 14:
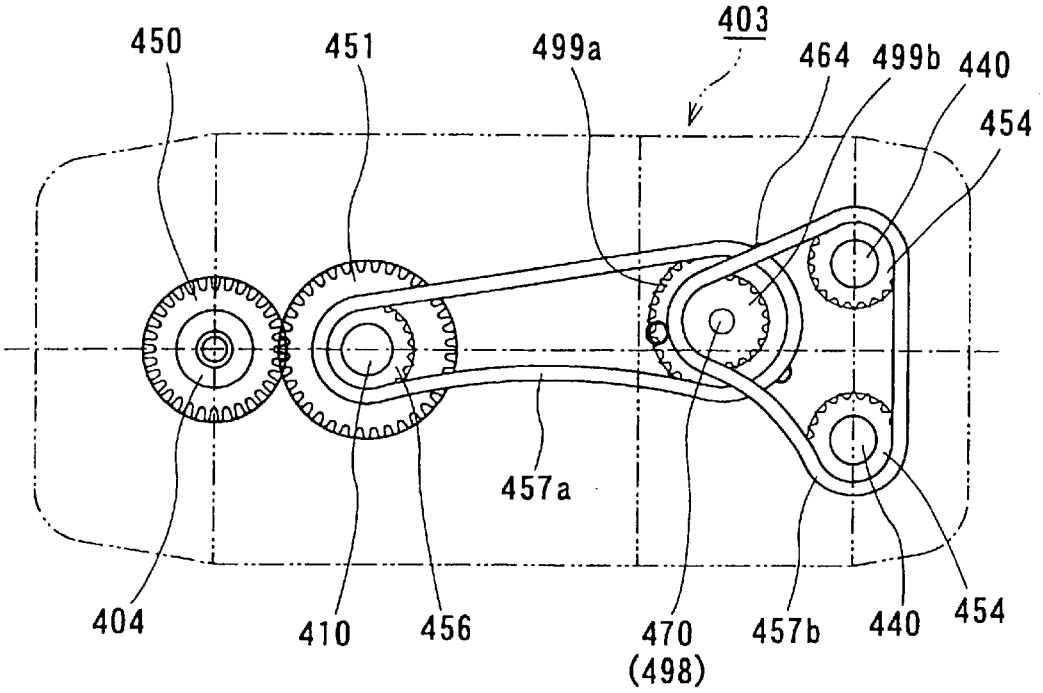
FIG. 14 is a simplified diagram of the camshafts and the oil pump drive mechanism in a fifth embodiment of the present invention.

FIG. 14 is a simplified diagram of camshafts and an oil pump drive mechanism in a fifth embodiment according to the present invention. With an engine 403 in FIG. 14, a crank gear 450 is provided to a crankshaft 404, and a driven gear 451 that meshes with the crank gear 450 is provided to a drive shaft 410 that is offset from this crankshaft 404. Also, an idler shaft 498 is provided between the drive shaft 410 and two camshafts 440.

A timing sprocket 454 is provided coaxially with the driven gear 451 to the drive shaft 410, two idler sprockets 499*a* and 499*b* are provided to the idler shaft 498, and a first timing chain 457*a* is looped around the idler sprocket 499*a* and the timing sprocket 454.

Cam sprockets 456 are provided to the two camshafts 440, and a second timing chain 457*b* is looped around the idler sprocket 499*b* and the cam sprockets 456. The idler shaft 498 functions as a pump drive shaft 470 of the oil pump 464, and the oil pump 464 is driven by the rotation of the crankshaft 404.

When two idler sprockets 399 or 499 are provided to an idler shaft 398 or 498 with the engine 303 or 403 shown in FIGS. 12–13 or 14, the diameter of the cam sprockets 356 or 456 can be reduced if the number of teeth on the idler sprockets 399 or 499 is set so that the crankshaft 304 or 404 is rotated at a lower speed. As a result, the included angle (not shown) of the exhaust valves 38 and intake valves 39 can be smaller, which allows the combustion chambers 33 (not shown) to be more compact and enhances the performance of the engine 303 or 403.

With respect to the above embodiments, it is assumed the engine is equipped with two camshafts. However, a single camshaft may be used instead. An embodiment with a single camshaft will be described through reference to FIG. 15.

Figure 15:
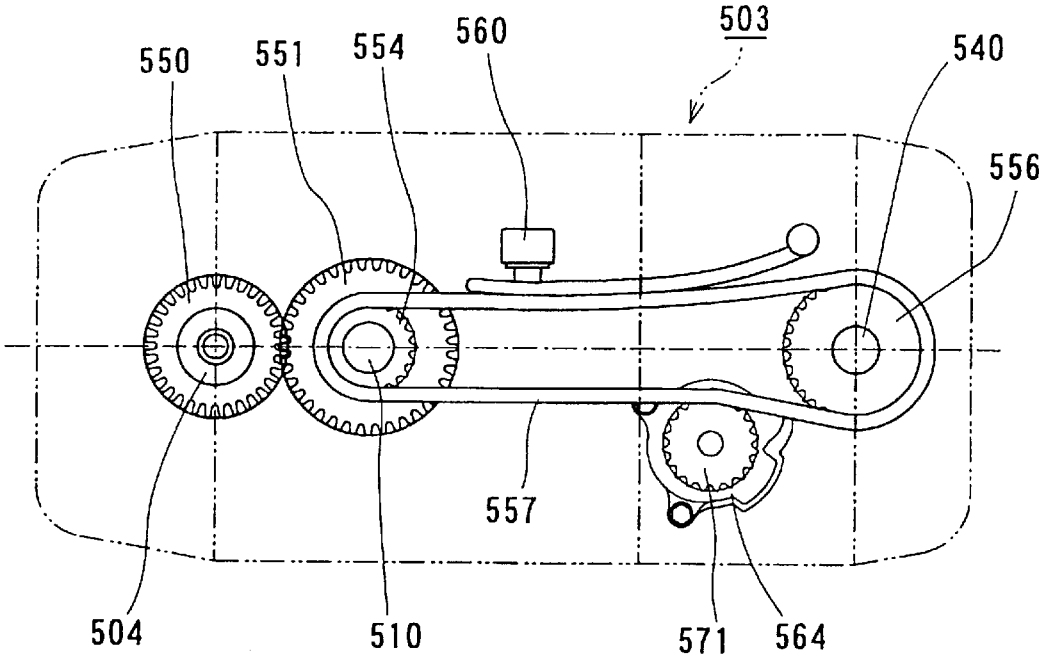
FIG. 15 is a simplified diagram of the camshafts and the oil pump drive mechanism in a sixth embodiment of the present invention.

FIG. 15 is a simplified diagram of camshafts and an oil pump drive mechanism in a sixth embodiment according to the present invention. With an engine 503 in FIG. 15, a crank gear 550 is provided to a crankshaft 504, and a driven gear 551 that meshes with the crank gear 550 is provided to a drive shaft 510 that is offset from this crankshaft 504. A timing sprocket 554 is provided coaxially with the driven gear 551 to the drive shaft 510, a cam sprocket 556 is provided to a single camshaft 540, a pump driven gear 571 is provided to an oil pump 564, and a timing chain 557 is looped around these sprockets 554 and 556, so that the oil pump 564 is driven by the rotation of the crankshaft 504.

With the engine 503 such as this equipped with a single camshaft 540, the outboard motor may be more compact if both the oil pump 564 and the tensioner adjuster 560 are disposed outside of the timing chain 557.

The crankshaft and the oil pump are indirectly linked in the above-mentioned embodiment. However, it is also possible to drive the oil pump directly with the crankshaft if a camshaft drive mechanism similar to that in the above-mentioned embodiments is provided. An embodiment thereof is illustrated in FIG. 16.

Figure 16:
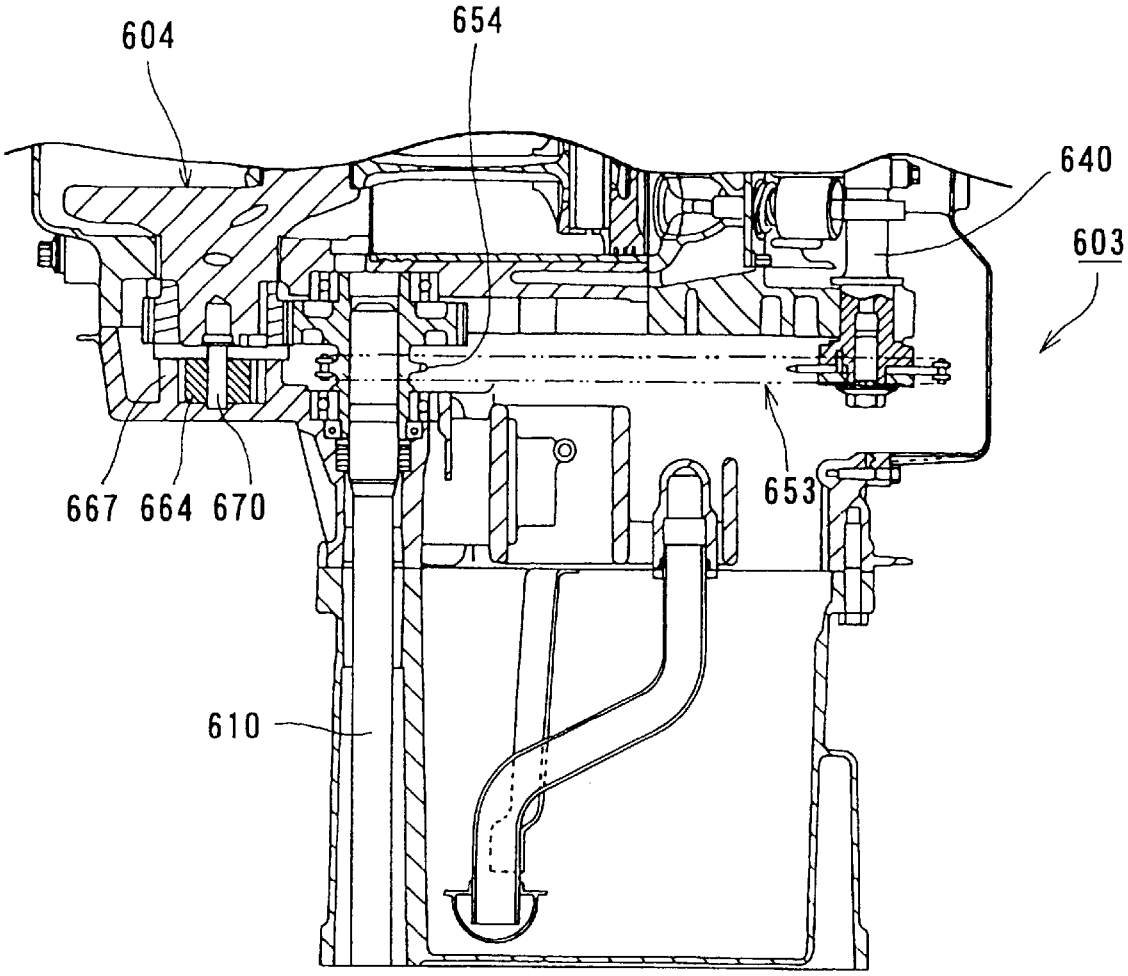
FIG. 16 is a vertical cross section of the center part of the engine in a seventh embodiment of the present invention.

FIG. 16 is a vertical cross section of the center part of the engine in a seventh embodiment according to the present invention. As shown in FIG. 16, a camshaft drive mechanism 653 for transmitting the rotation of a crankshaft 604 to camshafts 640 to rotationally drive the camshafts 640 is provided in the space between the bottom of the engine 603 and the top surface of an engine holder 602. A pump case 667 is integrally formed within the engine holder 602 directly under the lower end of the crankshaft 604, and an oil pump 664 is housed inside this pump case 667. A pump drive shaft 670 of this oil pump 664 is connected to the lower end of the crankshaft 604, and the oil pump 664 is driven by the rotation of the crankshaft 604. The numerical references 610 and 654 in the figure indicate a drive shaft, and a timing sprocket, respectively.

Integrally forming the pump case 667 inside the engine holder 602 makes it possible to reduce the number of parts required.

ADVANTAGES OF THE INVENTION

As described above, the four-cycle outboard motor, according to the present invention, having a crankshaft disposed substantially vertically within the engine, wherein the rotation of this crankshaft is transmitted to the valve camshafts via a looped member disposed at the bottom of the engine, the oil pump disposed at the bottom of the engine but not along the axis of the crankshaft or the camshafts, wherein either this oil pump or the tension adjuster of the looped member is disposed inside of the looped member in plan view and wherein the other is disposed outside of the looped member in plan view, may simplifies the construction so that the outboard motor may be more compact. Further, the reliability of the camshaft drive mechanism and the lubrication apparatus may also be enhanced.

Also, the outboard motor becomes more compact in the vertical direction because the above-mentioned oil pump is disposed overlapping with the above-mentioned looped member in a side view.

Furthermore, because the oil pump drive apparatus is provided to the above-mentioned camshaft and because the oil pump is driven by this oil pump drive apparatus, there is no need to move the entire engine upward, i.e., the engine may not have to be disposed in higher position so that the outboard motor can be more compact in the vertical direction.

In addition, because the above-mentioned oil pump drive apparatus is set up to drive the oil pump at a higher speed than the camshafts, the oil pump can be smaller, the layout of components at the bottom of the engine may have more options so that the outboard motor can be more compact.

In the outboard motor in which the crankshaft is disposed substantially vertically within the engine, wherein the rotation of this crankshaft is transmitted to the valve camshafts via the looped member disposed at the bottom of the engine, the oil pump is disposed at the bottom of the engine but not along the axis of the crankshaft or the camshafts, wherein the oil pump is driven by the looped member, so that fewer parts may be required and that the weight may be reduced to lead a lower cost.

In the outboard motor in which the crankshaft is disposed substantially vertically within the engine, wherein the rotation of this crankshaft is transmitted to the valve camshafts via the idler shaft and the two looped members disposed at the bottom of the engine, the oil pump is disposed at the bottom of the engine, wherein the oil pump is driven by the idler shaft, so that fewer parts may be required and that the weight may be reduced to lead a lower cost.

The above-mentioned idler shaft is also reduced in speed, so the outboard motor may be more compact and the engine performance may be enhanced.

In the outboard motor in which the crankshaft is disposed substantially vertically within the engine, wherein the rotation of this crankshaft is transmitted to the valve camshafts via the looped member disposed at the bottom of the engine, the oil pump is disposed at the bottom of the engine but not along the axis of the crankshaft and the camshafts, wherein the oil pump and the tensioner of the looped member are disposed outside of the looped member in plan view, so that the outboard motor may be made more compact, particularly, when the outboard motor is equipped with just one camshaft.

Furthermore, since the drive shaft is linked to the crankshaft, since the crankshaft and the drive shaft are disposed such that their axes (or shaft centers) are offset from each other, and since the axis of the drive shaft is disposed toward the rear (i.e., toward the cylinder head) away from the axis of the crankshaft, the fore-and-aft length of the outboard motor can be shortened so that the outboard motor can be more compact.

Also, since the sprocket or pulley for driving the above-mentioned camshafts is provided coaxially with the above-mentioned drive shaft, the construction is simplified so that fewer parts may be required and the cost of the outboard motor may be lowered.

In the outboard motor in which the crankshaft is disposed substantially vertically within the engine, wherein the rotation of this crankshaft is transmitted to the valve camshafts via the looped member disposed at the bottom of the engine, the drive shaft being linked to the crankshaft, wherein the crankshaft and the drive shaft are disposed such that their axes are offset from each other and wherein the axis of the drive shaft is disposed farther to the rear of the hull than the axis of the crankshaft, the sprocket or pulley for driving the camshafts being provided coaxially with the drive shaft, the oil pump is disposed coaxially with the crankshaft, wherein this oil pump is driven by the crankshaft, so that this oil pump is driven by the crankshaft and that fewer parts may be required.

Furthermore, the oil intake passage and the oil discharge passage extending from two sides of the cylinder head toward the oil pump and substantially at a right angle to the axis of the cylinder in plan view are provided inside the engine, so that no complicated oil passage is needed and that the cost may be reduced, resulting in greater flexibility in the layout and a more compact outboard motor.

What is claimed is:

1. A four-cycle outboard motor having a crankshaft disposed substantially vertically within an engine, rotation of the crankshaft being transmitted to a valve camshaft via a looped member disposed at a bottom of the engine, said outboard motor comprising:

an oil pump disposed at the bottom of the engine but not along an axis of the crankshaft or the camshaft and a tension adjuster of the looped member, wherein either the oil pump or the tension adjuster is disposed inside the looped member in plan view and wherein the other of the oil pump or the tension adjuster is disposed outside the looped member in plan view.

2. The four-cycle outboard motor according to claim 1, wherein the oil pump overlaps the looped member as viewed from a side of the engine.

3. The four-cycle outboard motor according to claim 2, further comprising an oil pump drive apparatus provided to the camshaft, wherein the oil pump is driven by the oil pump drive apparatus.

4. The four-cycle outboard motor according to claim 3, wherein the oil pump drive apparatus drives the oil pump at a higher rotational speed than the camshaft.

5. The four-cycle outboard motor according to claim 1, further comprising an oil pump drive apparatus provided to the camshaft, wherein the oil pump is driven by the oil pump drive apparatus.

6. The four-cycle outboard motor according to claim 5, wherein the oil pump drive apparatus drives the oil pump at a higher rotational speed than the camshaft.

7. The four-cycle outboard motor according to claim 1, characterized in that the crankshaft is linked to a drive shaft, in that the crankshaft and the drive shaft are disposed such that their axes are offset from each other, and in that the axis of the drive shaft is disposed toward the rear away from the axis of the crankshaft.

8. The four-cycle outboard motor according to claim 7, further comprising a rotational force transmitting member for driving the camshafts being provided coaxially with the drive shaft.

9. The four-cycle outboard motor according to claim 1, further comprising:

an oil intake passage being provided inside the engine, an oil discharge passage being provided inside the engine, wherein the oil intake passage and the oil discharge passage extend from one side and another opposite side of the engine, respectively, toward the oil pump substantially perpendicular to an axis of a cylinder in plan view.

10. A four-cycle outboard motor having a crankshaft disposed substantially vertically within an engine, rotation of this crankshaft being transmitted to a valve camshaft via a looped member disposed at a bottom of the engine, said outboard motor comprising:

an oil pump disposed at the bottom of the engine but not along an axis of the crankshaft or the camshaft, wherein the oil pump is driven by the looped member.

11. The four-cycle outboard motor according to claim 10, characterized in that the crankshaft is linked to a drive shaft, in that the crankshaft and the drive shaft are disposed such that their axes are offset from each other, and in that the axis of the drive shaft is disposed toward the rear away from the axis of the crankshaft.

12. The four-cycle outboard motor according to claim 11, further comprising a rotational force transmitting member for driving the camshafts being provided coaxially with the drive shaft.

13. The four-cycle outboard motor according to claim 10, further comprising:

an oil intake passage being provided inside the engine, an oil discharge passage being provided inside the engine, wherein the oil intake passage and the oil discharge passage extend from one side and another opposite side of the engine, respectively, toward the oil pump substantially perpendicular to an axis of a cylinder in plan view.

14. A four-cycle outboard motor having a crankshaft disposed substantially vertically within an engine, rotation of the crankshaft being transmitted to a valve camshaft via an idler shaft and two looped members disposed at the bottom of the engine, said outboard motor comprising:

an oil pump disposed at the bottom of the engine, wherein the oil pump is driven by the idler shaft.

15. The four-cycle outboard motor according to claim 14, further wherein the idler shaft is driven at a reduced rotational speed from the crankshaft.

16. The four-cycle outboard motor according to claim 14, characterized in that the crankshaft is linked to a drive shaft, in that the crankshaft and the drive shaft are disposed such that their axes are offset from each other, and in that the axis of the drive shaft is disposed toward the rear away from the axis of the crankshaft.

17. The four-cycle outboard motor according to claim 16, further comprising a rotational force transmitting member for driving the camshafts being provided coaxially with the drive shaft.

18. The four-cycle outboard motor according to claim 14, further comprising:

an oil intake passage being provided inside the engine, an oil discharge passage being provided inside the engine, wherein the oil intake passage and the oil discharge passage extend from one side and another opposite side of the engine, respectively, toward the oil pump substantially perpendicular to an axis of a cylinder in plan view.

19. A four-cycle outboard motor having a crankshaft disposed substantially vertically within an engine, rotation of the crankshaft is transmitted to a valve camshaft via a looped member disposed at the bottom of the engine, said outboard motor comprising:

an oil pump disposed at the bottom of the engine but not along an axis of the crankshaft or the camshaft, and a tensioner of the looped member;

wherein the oil pump and the tensioner are disposed outside the looped member in plan view.

20. The four-cycle outboard motor according to claim 19, characterized in that the crankshaft is linked to a drive shaft, in that the crankshaft and the drive shaft are disposed such that their axes are offset from each other, and in that the axis of the drive shaft is disposed toward the rear away from the axis of the crankshaft.

21. The four-cycle outboard motor according to claim 20, further comprising a rotational force transmitting member for driving the camshafts being provided coaxially with the drive shaft.

22. The four-cycle outboard motor according to claim 19, further comprising:

an oil intake passage being provided inside the engine, an oil discharge passage being provided inside the engine, wherein the oil intake passage and the oil discharge passage extend from one side and another opposite side of the engine, respectively, toward the oil pump substantially perpendicular to an axis of a cylinder in plan view.

23. A four-cycle outboard motor having a crankshaft being disposed substantially vertically within an engine, rotation of the crankshaft being transmitted to a valve camshaft via a looped member disposed at the bottom of the engine, said outboard motor comprising:

a drive shaft being linked to the crankshaft, wherein the crankshaft and the drive shaft are disposed such that their axes are offset from each other and wherein the axis of the drive shaft is disposed toward the rear away from the axis of the crankshaft, a rotational force transmitting member for driving the camshaft being provided coaxially with the drive shaft, and an oil pump being disposed coaxially with the crankshaft, wherein the oil pump is driven by the crankshaft.

24. The four-cycle outboard motor according to claim 23, further comprising:

an oil intake passage being provided inside the engine, an oil discharge passage being provided inside the engine, wherein the oil intake passage and the oil discharge passage extend -from one side and another opposite side of the engine, respectively, toward the oil pump substantially perpendicular to an axis of a cylinder in plan view.

* * * * *